US005575046A

United States Patent [19]

Rourke

[11] Patent Number: 5,575,046

[45] Date of Patent: Nov. 19, 1996

[54] HOLDER FOR SUSPENDING ARTICLES

[75] Inventor: Christopher R. G. Rourke, Gordon, Australia

[73] Assignee: Klingers Peg-Free Clothes Lines Pty. Limited, Asquith, Australia

[21] Appl. No.: 392,752

[22] PCT Filed: Aug. 24, 1993

[86] PCT No.: PCT/AU93/00432

§ 371 Date: Mar. 30, 1995

§ 102(e) Date: Mar. 30, 1995

[87] PCT Pub. No.: W094/04742

PCT Pub. Date: Mar. 3, 1994

[30] Foreign Application Priority Data

Aug. 25, 1992 [AU] Australia ..... 21302/92

[51] Int. Cl.[6] ..... D06F 53/02

[52] U.S. Cl. ..... 24/563; 24/341; 24/578; 211/124; 211/119.1

[58] Field of Search ..... 24/30.55, 563, 24/341, 338, 578; 211/124, 119.1, 89, 119.13; 59/78, 84, 85, 90

[56] References Cited

U.S. PATENT DOCUMENTS

| | | | |
|---|---|---|---|
| 1,198,562 | 9/1916 | McClure | 211/119.13 X |
| 1,321,735 | 11/1919 | Graves | 24/338 |
| 1,469,281 | 10/1923 | Stevens | 24/563 |
| 2,402,220 | 6/1946 | Whelan | 211/119.13 X |
| 2,580,589 | 1/1952 | Pfleger et al. | 59/85 |
| 2,981,990 | 5/1961 | Balderree, Jr. | 24/30.5 S |
| 3,962,757 | 6/1976 | Gedney | 24/30.5 S |
| 4,540,034 | 9/1985 | Young | 24/563 X |

FOREIGN PATENT DOCUMENTS

| | | | |
|---|---|---|---|
| 114289 | 12/1941 | Australia | 211/119.13 |
| 2022467 | 11/1971 | Germany | 211/119.13 |

*Primary Examiner*—James R. Brittain
*Attorney, Agent, or Firm*—Smith-Hill and Bedell

[57] ABSTRACT

A link for a pegless clothes line is molded from resilient plastic material and has a stud formation at one end and a recess for receiving a neck of the stud formation of the adjacent link, at the other end. A diamond-shaped aperture opens at one end into an entrance to the recess, and at the other end into an undulating pinch slot of V-shaped cross section. Clothes to be dried have their corners poked through the apertures and are then slid sideways along the pinch slots which hold them in position. Oblique bars enhance the resilience of the sides of the pinch slot.

3 Claims, 4 Drawing Sheets

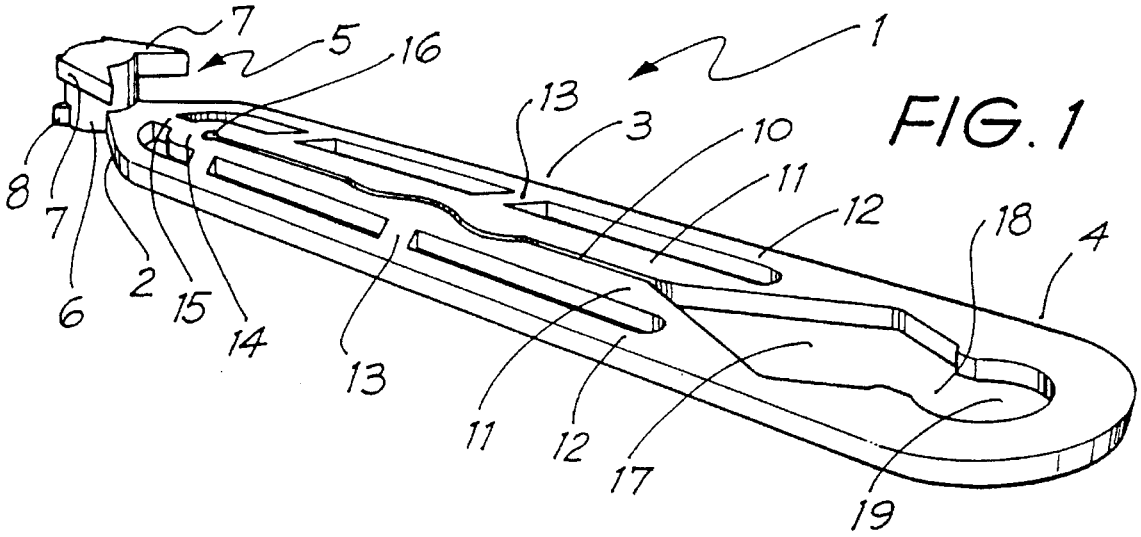
FIG. 1
FIG. 2
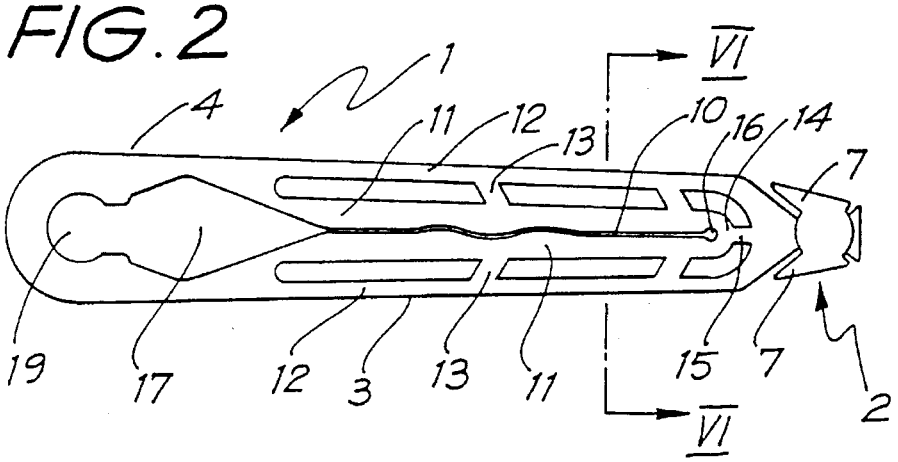
FIG. 3
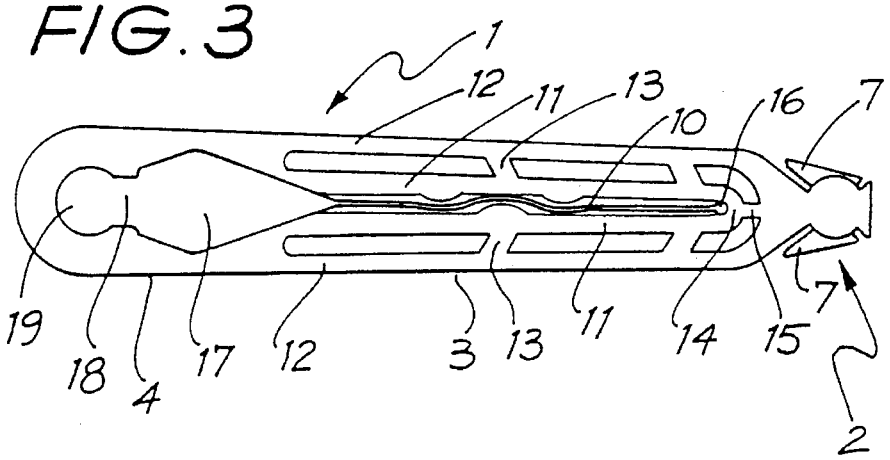

FIG. 4
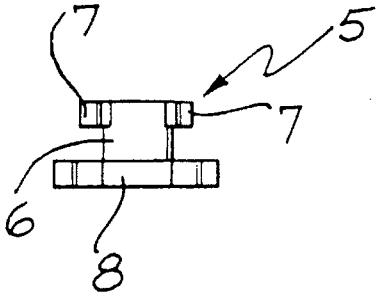
FIG. 5
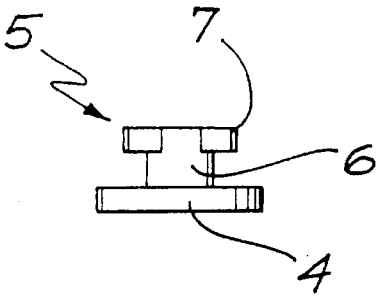
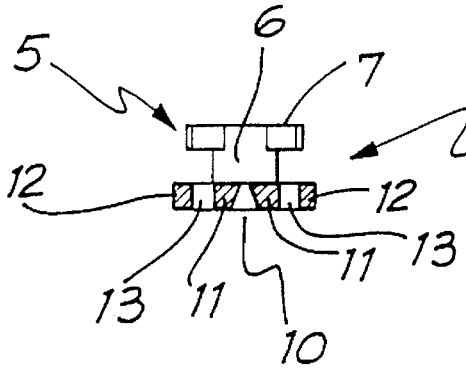
FIG. 6
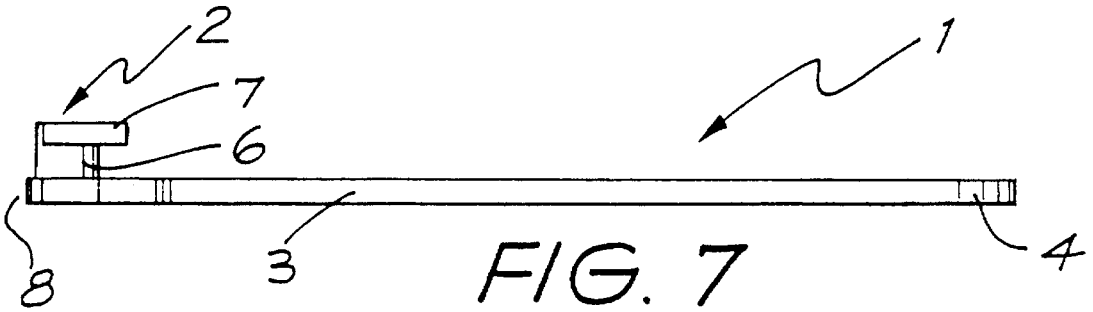
FIG. 7
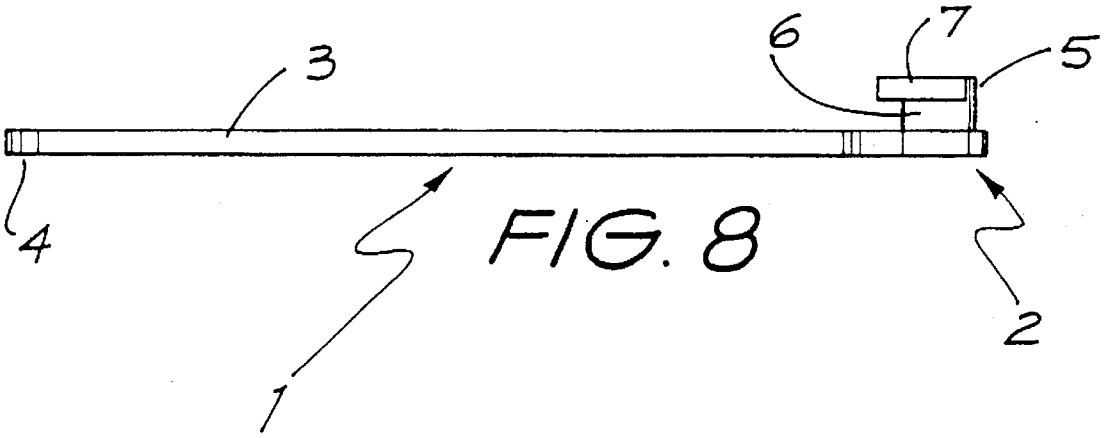
FIG. 8

HOLDER FOR SUSPENDING ARTICLES

FIELD OF THE INVENTION

THIS INVENTION relates to a holder for supporting a cloth to be dried, and is more specifically, but not exclusively concerned with a pegless clothes line composed of a series of links formed with resilient pinches into which upper edge-portions of clothes to be dried can be slid and held.

STATE OF THE ART

Pegless clothes lines are disclosed in Australian Patent Specification nos. 118,620, 117229, 116484, 114289, and 111923. All of these specifications rely on wire links which are attached to one another by inter-engaging loops at the ends of the links. As far as is known, such clothes lines have not found commercial acceptance either because of their cost, the difficulty of adjusting their length to suit a particular site, their proneness to rust, or their tendency to provide sharp points and edges liable to damage articles of clothing suspended from them.

OBJECT OF THE INVENTION

An object of this invention is the provision of an improved holder for supporting the upper end of a suspended article in a readily disconnectable manner.

SUMMARY OF THE INVENTION

In accordance with the broadest aspect of this invention a holder for suspending a cloth or other flexible article from its upper end, comprises an elongated plastics moulding having two opposite end-portions and an intermediate portion containing an elongated and non-linear pinch slot formed between two resilient side-portions of the moulding which, at one end-portion of the moulding, diverge away from one another to define part of an opening through which the upper end of the article can be guided into the pinch slot for subsequent retention thereon.

In accordance with a narrower aspect of the invention a link for a pegless clothes line comprises a plastics moulding of elongated form having a stud-like formation, having a neck and a head, at one end-portion; a resiliently-sided non-linear pinch slot extending along its intermediate portion; an opening formed in its other end-portion and communicating with the pinch slot; and,a recess which is slightly wider than the neck of the stud formation but smaller than its head and which has a mouth shaped to allow the neck to pass through it with an interference fit, to provide a hinge attaching each link to its neighbour.

PREFERRED FEATURES OF THE INVENTION

The pinch slot is preferably parallel-sided with a minimum slot width of about one millimetre, and is of undulating form.

Conveniently the intermediate portion of the moulding is of flattened form and the slot is of V-shaped cross-section with the vertex of "V" lying in one flat face of the intermediate portion.

A clothes line of a desired length may be made up from a chain of the links of the invention, each link having its stud formation located in the recess at the adjacent end of the neighbouring link. Preferably the entrance to the recess is located at one side of the opening and the pinch slot communicates with the other side of the opening which may be of generally diamond shape. The plastics material of the link has a natural resilience which allows the links to be snap-fitted to one another, and the sides of the pinch slots to yield resiliently, but within their elastic limits, when an article of clothing is slid between them. With this construction of link, the links, when strung together, lie in parallel planes with their adjacent end-portions overlapping one another.

The side-portions of the link at each side of the pinch slot are conveniently formed from two substantially parallel, spaced ribs interconnected by inclined bars which yield resiliently when clothing is slid into the pinch slot. The pinch slot preferably has undulating parallel sides which may include bulges which resist unwanted sliding movement of the clothing along the pinch slot under the influence of wind pressure.

In the preferred arrangement for carrying out the invention the pinch slot ends in a small hole at its end furthest from the opening.

INTRODUCTION TO THE DRAWINGS

The invention will now be described in more detail, by way of examples, with reference to the accompanying drawings, in which:

IN THE DRAWINGS

FIG. 1 perspective view of a moulded plastics link of a pegless clothes line;

FIG. 2 plan view of the link from above;

FIG. 3 an under plan view of the link;

FIG. 4 an elevation of the link from one end;

FIG. 5 is an end elevation of the link from the opposite end;

FIG. 6 vertical transverse section through the link of FIG. 2 taken along the line and in the direction of the arrows VI—VI in FIG. 2;

FIG. 7 is a link in side elevation from one side;

FIG. 8 shows the link of FIG. 7 viewed from the opposite side;

DESCRIPTION OF PREFERRED EMBODIMENT

Figure 9:
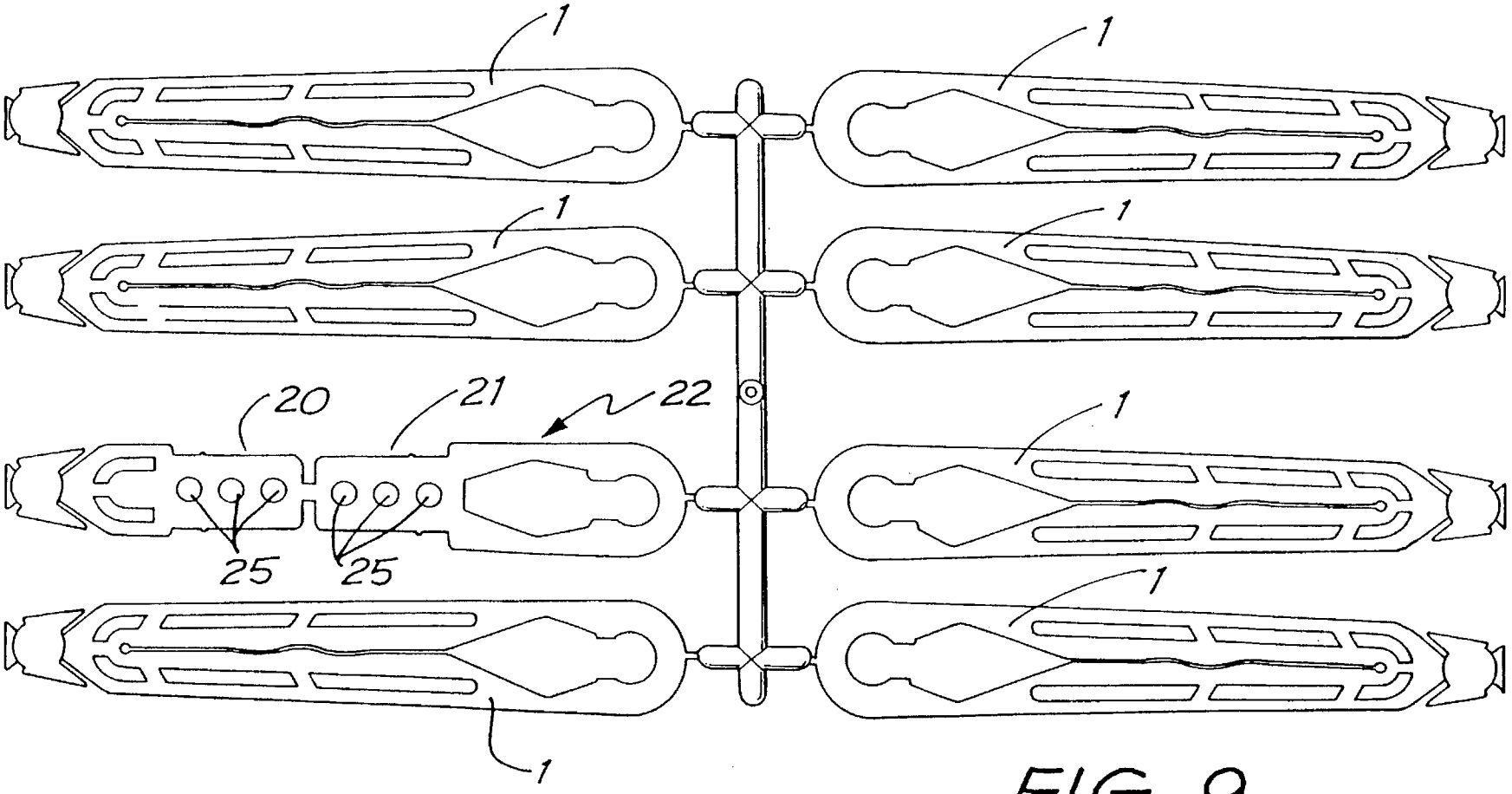
FIG. 9 shows, in plan, a one-piece injection moulding providing seven links and two end-connectors; and, FIG. 10 is a diagrammatic view of a clothes line constructed from a hinged-together links and partially broken away to illustrate its two ends and an intermediate portion.

In FIGS. 1 to 8, a link 1 of generally flattened form is injection-moulded from a resiliently flexible plastics material such as polypropylene, and is approximately eleven and one-half centimetres long, has a width tapering from two centimetres to one and one half centimetres wide, is nine millimetres high at one end portion 2, and is three millimetres thick along the remainder of its length constituted by an intermediate portion 3 and an end-portion 4.

The end portion 2 is formed with a stud formation 5 having a cylindrical neck 6 and an enlarged head composed of two wings 7 at one end of the neck. The intermediate portion 3 of the link extends away from one side of the stud formation 5. A shelf 8 extends from the neck 6 on the opposite side to the intermediate portion 3.

The intermediate portion 3 of the link is formed with a central non-linear pinch slot 10 having parallel sides of undulating form and formed between a pair of inner ribs 11 which are spaced inwardly of a pair of outer ribs 12. Each inner rib 11 is connected to the adjacent outer rib 12 by a pair of inclined, spaced bars 13. The inner ribs 11 are joined at their ends adjacent the stud formation 5 by a return bend 14 which is joined by a strip 15 to the end portion 2. The other ends of the inner ribs 11 diverge away from one another and become integral with the outer ribs 12 at the end portion 4 of the link.

The pinch slot 10 opens at one end into a circular hole 16 located within the return bend 14, and at the other end, into one end of a diamond-shaped opening 17 through which an article or cloth can be guided into the pinch slot. The other end of the opening 17 opens into an entrance 18 to a part-circular recess 19. The diameter of the recess 19 is slightly larger than that of the neck 6 of the stud formation but smaller than that of its head. The width of the entrance to the recess is slightly less than the diameter of the neck 6 of the stud formation. The size of the opening 17 is sufficient to enable the head of the stud formation to pass through it. The neck 6 can then be snapped through the entrance to the recess 19, which entrance is of slightly less width than the diameter of the neck 6.

As is shown in the sectional view of FIG. 6, the pinch slot 10 is of V-shaped cross-section, the sides of the slot converging towards the side of the link from which the stud formation 5 extends. The sides of the pinch slot 10 are also formed with bulges as is clearly shown in FIG. 3. The pinch slot has a uniform minimum width of about 1 millimetre, throughout its length.

Figure 10:
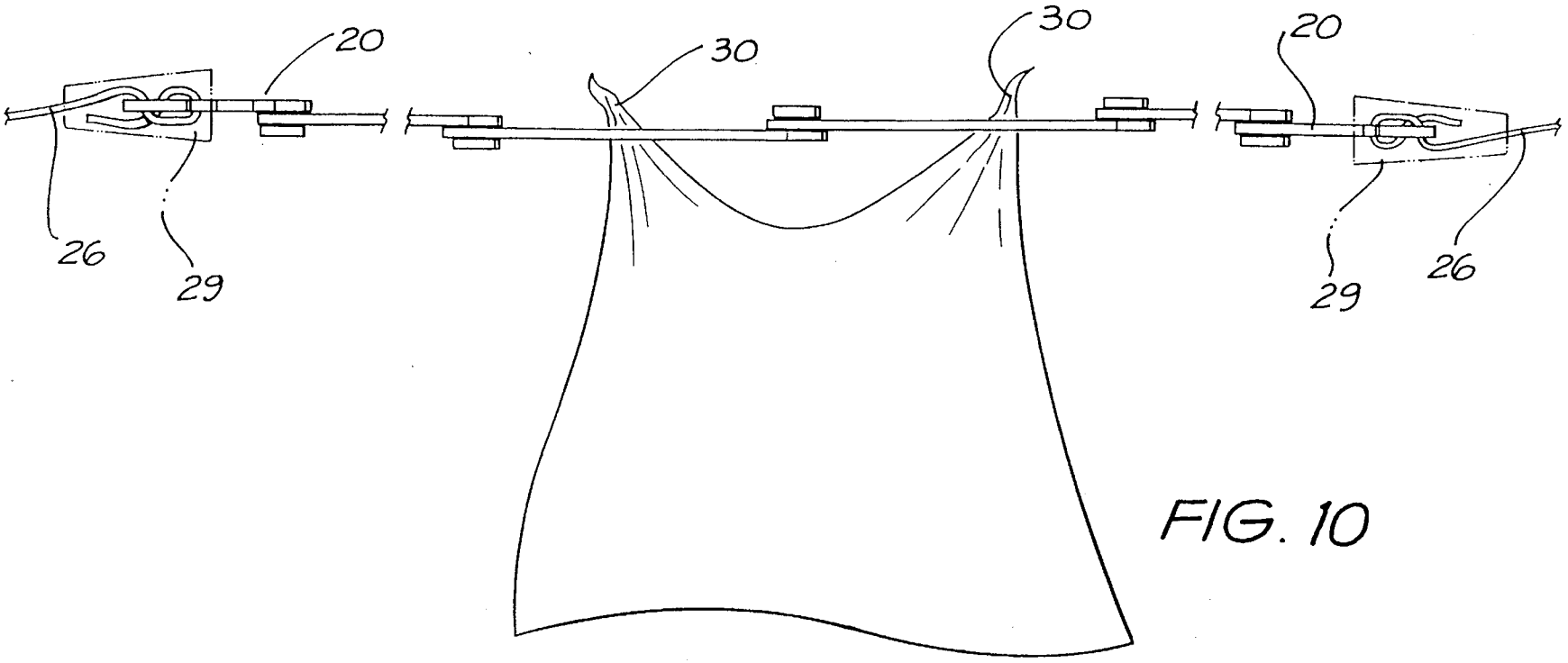

FIG. 9 shows how seven of the links 1 described can be made simultaneously from an injection moulding process, together with two end-connectors 20 and 21 which form opposite end-portions of a single component 22 moulded at the same time. Each of the end connectors 20,21 is formed with three spaced holds 25 which enable ends of a cord 26 to be attached to the end links 1 of the line, as is shown in FIG. 10. The end connector 20 is formed with a stud formation identical to that formed on the links to enable the connector 20 to be attached to the end of the line which terminates in an end-portion 4. The other end-connector 21 is formed with an opening and recess identical to that of the links 1 to enable it to be attached to the stud formation at the opposite end of the line as shown in FIG. 10.

OPERATION OF PREFERRED EMBODIMENT

To install the clothes line, a number of links 1 are interconnected with one another as shown in FIG. 10 and the end connectors 20 and 21 are attached. Lengths of cord are then attached to the end connectors 20, 21 as illustrated, and cups 29 may be slid over the free ends of the cords to cover the end-connectors so that their appearance is neat and the cords do not unthread themselves from the holes over a period of time.

Clothes to be dried have their upper corner portions 30 poked through the openings 17 and then slid sideways along the pinch slots 10 so that they are held securely between the inner ribs as shown in FIG. 10.

To remove the clothes from the line, their upper corner portions are slid sideways along the pinch slots 10 until they enter the openings 17 from which they can then be withdrawn.

The above-described clothes line can be cheaply made, is easy to install, is attractive in appearance and avoids the needs of separate clothes pegs. The line may be used as a free straight line or may be looped between, or along the arms of a Hills Hoist clothes tree. A particular advantage of the construction of clothes line described, is that it does not tangle when folded up with a Hills Hoist tree. Also, the interconnected links of the clothes line can be folded into a compact stack of links arranged side-by-side, which makes for a compact stowage of the line. The subsequent erection of the line is made simple because of the limitation of the links to-movement in one plane, by the nature of the hinge joints formed between them.

MODIFICATIONS OF THE INVENTION

Although the invention has been specifically described with reference to a link for a pegless clothes line, it is not to be construed as being limited to such usage. The invention may, for example, be used in other shapes of holder than the links shown in the drawing. For example the invention may be used to provide a holder for suspending a garment or other article for display purposes, and need not take the form of a link for a clothes line.

I claim:

1. A holder for suspending a cloth or other flexible article from an upper end, comprising an elongated plastics moulding having two opposite end portions and an intermediate portion providing an elongated and non-linear pinch slot formed between two resilient side portions of the moulding which, at one end portion of the moulding, diverge away from one another to define part of an opening through which the upper end of the article can be guided into the pinch slot for subsequent retention therein, and in which each side portion of the moulding comprises an inner rib and an outer rib in parallel spaced relationship and between which extend diagonal bars to permit individual sections of the inner ribs to flex outwardly to different extents to accommodate variations in the thickness of the article trapped in the pinch slot formed between the two inner ribs.

2. A holder for suspending a cloth or other flexible article from an upper end, said holder being constructed as a link for a pegless clothes line and comprising an elongated plastics moulding having first and second opposite end portions, the moulding having at the first end portion a stud-like formation provided with a neck and a head and having at the second end portion a recess which is slightly wider than the neck of the stud formation but smaller than its head and which has a mouth shaped to allow the stud neck to pass through it with an interference fit to provide a hinge attaching each link to its neighbor, and the moulding also having an intermediate portion providing an elongated and non-linear pinch slot formed between two resilient side portions of the moulding which, at the second end portion of the moulding, diverge away from one another to define part of an opening through which the upper end of the article can be guided into the pinch slot for subsequent retention therein, and wherein the mouth of the recess is located to one side of the opening, and the pinch slot communicates with the other side of the opening.

3. A holder for suspending a cloth or other flexible article from an upper end, said holder being constructed as a link for a pegless clothes line and comprising an elongated plastics moulding having first and second opposite end portions, the moulding having at the first end portion a stud-like formation provided with a neck and a head and having at the second end portion a recess which is slightly wider than the neck of the stud formation but smaller than its head and which has a mouth shaped to allow the stud neck to pass through it with an interference fit to provide a hinge attaching each link to its neighbor, and the moulding also having an intermediate portion providing an elongated and non-linear pinch slot formed between two resilient side portions of the moulding which, at the second end portion of the moulding, diverge away from one another to define part of an opening through which the upper end of the article can be guided into the pinch slot for subsequent retention therein, and in which the stud-like formation has a cylindrical neck and its head is formed by a pair of V-shaped wings lying in a plane spaced from a plane containing the intermediate portion of the link.

* * * * *